United States Patent [19]

Yahagi

[11] Patent Number: 4,595,901

[45] Date of Patent: Jun. 17, 1986

[54] INDUCTANCE DEVICE WITH BONDED METAL FOIL ELECTRODES

[75] Inventor: Tadao Yahagi, Tokyo, Japan

[73] Assignee: TDK Electronics Co., Ltd., Tokyo, Japan

[21] Appl. No.: 550,197

[22] Filed: Feb. 16, 1984

Related U.S. Application Data

[63] Continuation of Ser. No. 378,327, May 14, 1982, abandoned, which is a continuation of Ser. No. 186,123, Sep. 11, 1980, abandoned.

[51] Int. Cl.[4] ..... H01F 15/10

[52] U.S. Cl. ..... 336/192; 336/96; 336/208

[58] Field of Search ..... 336/192, 221, 180, 96, 336/200, 205, 83, 65, 105, 107; 338/327, 329, 328, 322, 308; 174/94 R, 117 A; 219/203, 541; 361/308; 323/355, 370; 333/184

[56] References Cited

U.S. PATENT DOCUMENTS

| | | | |
|---|---|---|---|
| 1,483,539 | 2/1924 | Allcutt | 338/328 X |
| 3,076,947 | 2/1963 | Davidson, Jr. | 336/83 X |
| 3,521,200 | 7/1970 | Matsushima et al. | 333/184 |
| 3,560,904 | 2/1971 | Wilkes | 336/180 |
| 3,918,783 | 11/1975 | Du Rocher et al. | 219/203 X |
| 4,103,274 | 7/1978 | Burgess et al. | 338/327 X |
| 4,213,028 | 7/1980 | Wolf | 219/541 X |
| 4,231,041 | 10/1980 | Graeser, Jr. et al. | 174/94 R X |
| 4,314,221 | 2/1982 | Satou et al. | 336/192 |

FOREIGN PATENT DOCUMENTS

| | | | |
|---|---|---|---|
| 879085 | 10/1961 | United Kingdom | 336/192 |

*Primary Examiner*—Thomas J. Kozma

*Attorney, Agent, or Firm*—Oblon, Fisher, Spivak, McCelland & Maier

[57] ABSTRACT

An inductance device comprises a coil wound on a magnetic core; and an electrode layer made of a metal foil bonded on an end surface of said magnetic core on which an end of said coil and an end of a lead wire are soldered on said metal foil.

2 Claims, 7 Drawing Figures

INDUCTANCE DEVICE WITH BONDED METAL FOIL ELECTRODES

This is a continuation of application Ser. No. 378,327, filed May 14, 1982, now abandoned, which is a continuation of application Ser. No. 186,123, filed Sept. 11, 1980, now abandoned.

BACKGROUND OF THE INVENTION

1. Field of the Invention

The present invention relates to an inductance device such as a peeking coil used in a wideband amplifier.

2. Description of the Prior Art

FIGS. 1 and 2 show the conventional inductance device wherein a coil (2) is wound on a winding part of a drum core (1), and a silver plate layer (4) formed on a surface of conical concaves (3) formed on both sides of the drum core (1) and a terminal (2*a*) of the coil (2) and a lead wire (5) are soldered on the silver plate layer to connect them and the outer part thereof is covered with an insulating outer film (6).

In the case of electronic parts for low costs such as the peeking coil, it is not economically allowed to use an expensive noble metal such as silver. Moreover, the silver electrode should be formed by melting silver, whereby silver is scattered to needless parts so as to cause dirty spots on the coil to cause short-circuit or to cause fluctuations of a loss coefficient or a self-resonant frequency.

SUMMARY OF THE INVENTION

It is an object of the present invention to overcome the above-mentioned disadvantages and to provide an inductance device having uniform characteristics in stable quality with a remarkably low cost.

The foregoing and other objects of the present invention have been attained by providing an inductance device wherein each metal foil made of an electric conductive material such as copper and aluminum is bonded onto both end surfaces of a magnetic core and each end of a coil wound on said magnetic core and a lead wire are soldered on said metal foils.

The metal foil can be bonded onto each concave parts formed on both end surface of said magnetic core.

BRIEF DESCRIPTION OF THE DRAWINGS

FIG. 6(*b*) shows a graph of Q values for the conventional inductance device using a silver plate.

DETAILED DESCRIPTION OF THE PREFERRED EMBODIMENTS

Figure 1:
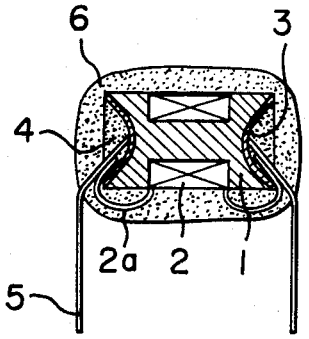
FIG. 1 PRIOR ART
FIGS. 1 and 2 show structures of the conventional inductance devices.
Figure 2:
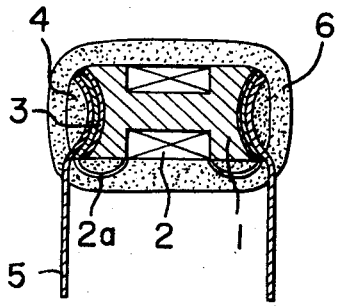
FIG. 2 PRIOR ART

The inductance device of the present invention has the structure in which each metal foil made of copper or aluminum etc is bonded on both end surfaces of the magnetic core instead of the silver plate layer in the conventional device and each end of the coil and the each wire are soldered onto each metal foil. In the inductance device having such structure, the metal foil such as the copper foil or aluminum foil is remarkably economical in comparison with the noble metal such as silver and accordingly the cost is remarkably reduced.

The electrode layer can be formed by bonding the foil whereby the productivity can be remarkably improved and the products having uniform characteristics in stable quality can be produced and the characteristics can be further improved.

Referring to the drawings, the embodiments of the present invention will be illustrated.

Figure 3:
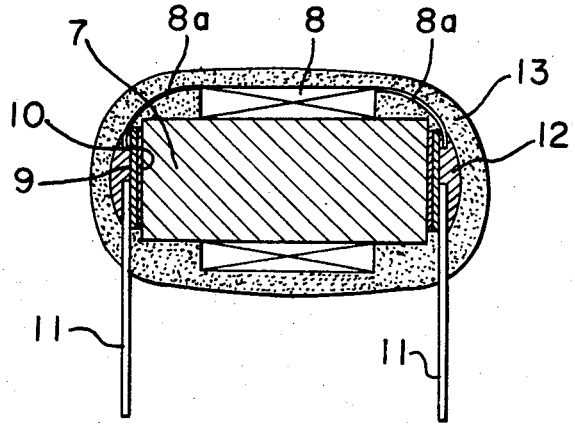
FIGS. 3 to 5 show structures of the inductance devices of the present invention.
Figure 4:
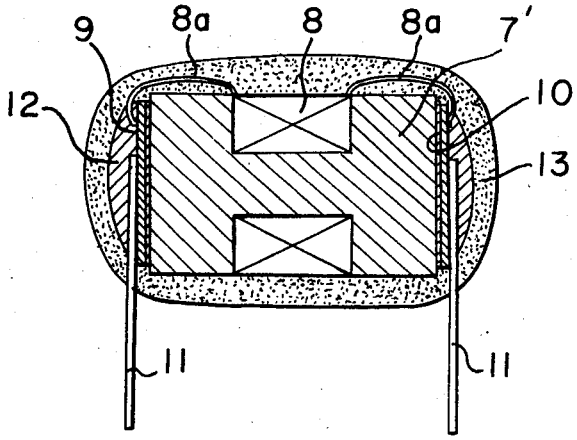
Figure 5:
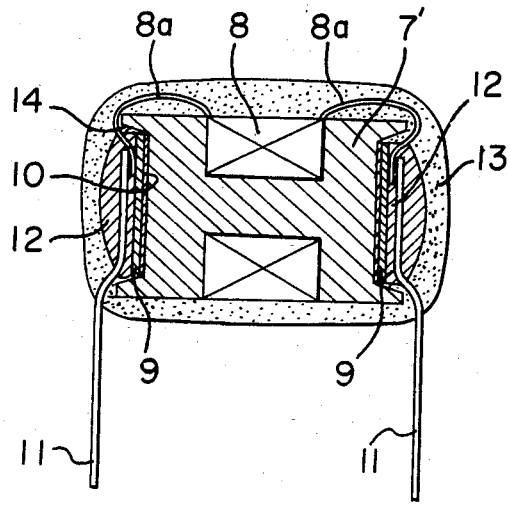

The inductance devices shown in FIGS. 3 to 5 are compact coil parts such as peeking coil, which have the structures in which a coil (8) is wound on a magnetic core such as a rod core (7) or a drum core (7'). Each economical electroconductive metal foil (9) made of copper, aluminum etc is bonded on both end surfaces of the magnetic core (7) or (7') with a binder or a solder (10) to form the electrode layers. The metal foils for the electrode layers can be in a form of sheet which can be prepared by cutting a broad metal sheet in a desired shape. A thermosettable binder can be coated on the bonding surfaces in the case of the binder bonding process. When the thermosettable binder is coated, the metal foil can be bonded on the end surfaces by heating under suitable pressure by a heat-press device. The bonding process can be remarkably simple. The end (8*a*) of the coil (8) is superposed or intertwined with the upper end of the lead wire (11) and brought into contact with the metal foil. The contact parts are bonded onto the surface of the metal foil with the solder (12) so as to place the lead wire terminals (11) projected downwardly from both sides of the magnetic coil (7) or (7'). An insulating film (13) covers over the magnetic core (7) or (7') so as to form the inductance device as a product.

As shown in FIG. 5, each concave (14) having a desired configuration such as a circular or rectangular configuration is formed on each end surface of the magnetic core. Each end surface of the magnetic core includes recessed ends defined by interior side surfaces extending to a recessed flat bottom surface and the metal foil (9) can be bonded in the concave (14) to the recessed flat bottom surface whereby the metal foil (9) is not easily slipped and can be easily bonded at a predetermined position on the side surface of the magnetic core and the assembling can be simplified.

In accordance with the inductance device having such structure, the electrode layer (9) is made of an economical material such as copper and aluminum without using an expensive material such as silver. The electrode layer (9) can be formed by bonding a metal foil made of copper or aluminum etc. whereby the treatment of a molten metal required for the silver plating or the baking at 700 to 900° C. required for the silver plating is not required. The electrode layer (9) is formed by using a metal foil having a predetermined size whereby the equality and characteristics of the inductance device such as loss coefficient and self-resonant frequency are specified and improved.

Figure 6A:
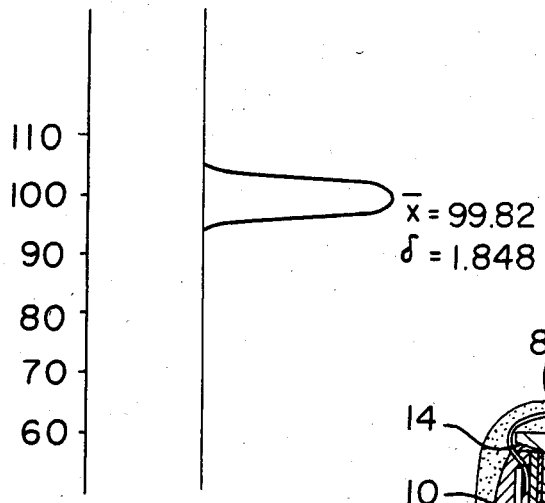
FIG. 6(*a*) shows a graph of Q values for the inductance device using a copper foil.
Figure 6B:
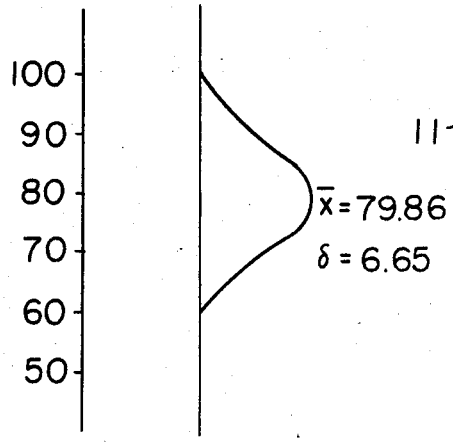

The variation of the characteristics on Q value was studied to find that the stability of Q value of the device using the metal foil electrode layer shown in FIG. 6(*a*) is remarkably superior to that of the conventional device using the silver plate electrode layer shown in FIG. 6(*b*).

In accordance with the inductance device of the present invention, the assembling can be simplified and the energy for baking can be saved to produce economical products and an ideal inductance device having desired predetermined characteristics can be obtained and the quality and characteristics can be further improved.

I claim:

1. An inductance device comprising:

a pair of lead wires;

a magnetic core having an exterior lateral surface extending to opposed recessed ends defined by interior side surfaces extending to a recessed bottom surface;

a coil would around said exterior lateral surface of said core, said coil having ends electrically connected to respective of said lead wires;

a pair of metal foils each comprising a metal selected from the group consisting of copper and aluminum and each bonded directly to a respective recessed bottom surface of a respective recessed end of said core by means of a thermosettable binder contacting each foil and said respective recessed bottom surface, said metal foils each having a main surface contacting only a portion of the respective end of said core and not the entire side surface of said respective recessed end; and respective of said lead wires and coil ends electrically connected to each other by being soldered to respective of said metal foils.

2. An inductance device according to claim 1, wherein said recessed bottom surfaces are substantially flat.

* * * * *

UNITED STATES PATENT AND TRADEMARK OFFICE

CERTIFICATE OF CORRECTION

PATENT NO. : 4,595,901

DATED : June 17, 1986

INVENTOR(S) : Yahagi, Tadao

It is certified that error appears in the above-identified patent and that said Letters Patent is hereby corrected as shown below:

-- The Priority information has been omitted from the Letters Patent. It should read as follows:

Japanese Utility Model Application No. 23736/1980, filed on February 26, 1980. --

Signed and Sealed this

*Ninth* Day of *September 1986*

[SEAL]

*Attest:*

DONALD J. QUIGG

*Attesting Officer*

*Commissioner of Patents and Trademarks*